US006659393B1

(12) United States Patent
Biserød

(10) Patent No.: US 6,659,393 B1
(45) Date of Patent: Dec. 9, 2003

(54) RETARDING AND LOCK APPARATUS AND METHOD FOR RETARDATION AND INTERLOCKING OF ELEMENTS

(75) Inventor: Hans B. Biserød, Raufoss (NO)

(73) Assignee: Nammo Raufoss AS, Raufoss (NO)

( * ) Notice: Subject to any disclaimer, the term of this patent is extended or adjusted under 35 U.S.C. 154(b) by 0 days.

(21) Appl. No.: 09/980,948

(22) PCT Filed: Jun. 2, 2000

(86) PCT No.: PCT/NO00/00192

§ 371 (c)(1),
(2), (4) Date: Mar. 29, 2002

(87) PCT Pub. No.: WO00/75602

PCT Pub. Date: Dec. 14, 2000

(30) Foreign Application Priority Data

Jun. 4, 1999 (NO) ..... 992739

(51) Int. Cl.[7] ..... F42B 10/14
(52) U.S. Cl. ..... 244/3.24; 244/3.26; 102/517
(58) Field of Search ..... 244/3.24, 3.3, 244/3.26; 102/518, 517, 374

(56) References Cited

U.S. PATENT DOCUMENTS 2,700,337 A * 1/1955 Cumming ..... 244/3.28
4,624,187 A * 11/1986 Bocker et al. ..... 102/520
4,628,821 A * 12/1986 Madderra et al. ..... 102/517
4,939,997 A * 7/1990 Hoffman ..... 102/503
5,160,805 A * 11/1992 Winter ..... 102/518
5,892,217 A * 4/1999 Pollin ..... 244/3.3
6,492,632 B1 * 12/2002 Pollin ..... 244/3.3

FOREIGN PATENT DOCUMENTS

| | | | | |
|---|---|---|---|---|
| DE | 3414834 | | 10/1985 | |
| DE | 3905907 A1 | * | 9/1990 | F42B/14/06 |
| DE | 4028409 A1 | * | 3/1992 | F42B/10/08 |
| DE | 4040337 | | 6/1992 | |
| FR | 2535450 A2 | * | 5/1984 | 102/517 |
| FR | 2650639 | | 2/1991 | |
| GB | 2236581 A | * | 4/1991 | F42B/10/04 |

* cited by examiner

*Primary Examiner*—Peter M. Poon
*Assistant Examiner*—Timothy D. Collins
(74) *Attorney, Agent, or Firm*—Knobbe, Martens, Olson & Bear, LLP

(57) ABSTRACT

A retarding and locking mechanism for use between two mutually translatable bodies. A first body can be induced into motion and guided into a second body and, after a predetermined movement of the first body, the first body is subject to retardation and interlocked to the second body, such that the first and second bodies together form a unitary, integrated body. The first body has a radially outwardly directed shoulder and the second body has a radially inwardly directed shoulder corresponding to the radially outwardly directed shoulder of the first body. A compressible element is provided between the shoulders of the first and second bodies.

13 Claims, 3 Drawing Sheets

RETARDING AND LOCK APPARATUS AND METHOD FOR RETARDATION AND INTERLOCKING OF ELEMENTS

RELATED APPLICATIONS

This application claims the benefit of the Norwegian application 1999 2739 filed Jun. 4, 1999 and the international application PCT/NO00/00192 filed Jun. 2, 2000. This application is related to co-pending applications "RELEASE MECHANISM IN A MISSILE" Ser. No. 10/009,281 "TRANSLATION AND LOCKING MECHANISM IN A MISSILE" Ser. No. 10/009,283 and "PROPELLING DEVICE FOR A PROJECTILE IN A MISSILE" Ser. No. 09/980,944 all filed concurrently herewith.

BACKGROUND OF THE INVENTION FIELD OF THE INVENTION

The present invention relates to a retarding and locking means for use between two bodies where the one, first body can be activated to motion and guidance into the other, second body and after a predetermined movement of the fist body is said first body being braked, or retarded, and perform thereafter interlocking with the second body and the interlocked bodies form together a unitary or integrated body.

The invention also relates to a method for retardation of a first body having kinetic energy and subsequent interlocking of the first body to a second body by use of deformation forces.

DESCRIPTION OF THE RELATED ART

The disclosed retarding and locking means is developed in connection with a missile, but is considered usable in other, civil relations where two main bodies are to be interlocked by means of kinetic energy and by deformation of a third body, or element, which is provided between the two main bodies. This can be actual for the integration of two basically separated bodies and where it either is not desired to weld or solder the bodies together or where the joining spot is inaccessible for a welding operation.

The further description of the invention is related to use in missiles, and in particular rocket accelerated penetrators. Rocket accelerated penetrators are often kept in their storing and standby state with the main parts thereof not assembled. This means that the part having control fins, the fin cone, and the rocket motor proper is assembled to the penetrator at the moment before the missile is launched from the launcher. The penetrator, which is in form of an arrow like body having substantial mass, is lying in standby position with the pointed end thereof supported in the control fin part. During launching preparations the penetrator is translated through the control fin part and the rear end of the penetrator is interlocked to the control fin part immediately before the rocket motor is ignited. It is common practise that the rocket motor is separated from the penetrator during the flight thereof as soon as the rocket motor is burned out and has lost its propelling force.

SUMMARY OF THE INVENTION

In accordance with the invention, a retarding and locking means of the introductorily mentioned kind is provided, which is distinguished in that the first body has a radially outwards directed shoulder and the second body has a radially inwards directed shoulder which correspond with the radially outwards directed shoulder, and that a compressible element is provided between said shoulders.

As a first option, the compressible element can be lying in standby position against the radially outwards directed shoulder.

As a second option, the compressible element can be lying in standby position against the radially inwards dirt shoulder.

Conveniently, the compressible element can be in form of a deformable sleeve. The sleeve may have a slight conical configuration and have a collar in at least one end thereof.

In one embodiment, the first and second body and the compressible element, can be cylindrical in the contacting surfaces thereof.

Preferably, the inwards directed shoulder may comprise an outwards directed recess in respect of the internal surface of the body.

Preferably, the outwards directed shoulder may comprise an inwards directed recess in, respect of the external surface of the body.

Further, after the interlocking option, said recesses can preferably be axially staggered in respect of each other.

In one embodiment of the invention the said bodies are included in a missile. The first body can be a penetrator and the second body can be a tail part having control fins.

In accordance with the present invention, a method of the introductorily mentioned kind is also provided, which is distinguished in that a deformable element is provided between the first and the second body and the kinetic energy of the first body is transferred to and absorbed in the deformable element during the retardation thereof over a predetermined retardation distance, said deformable element expands radially and engages surfaces on both bodies and after terminated retardation interlocks the bodies to each other in predetermined position.

Advantageously, the deformable body can be designed such that it is deforming in an accordion like pattern and forms a series of edges that do engage with the said surfaces.

Conveniently, the deformable clement can be designed such that the formation of edges occurs in more random orientations and in directions beyond radial planes.

Other and further objects, features and advantages will appear from the following description of one for the time being preferred embodiment of the invention, which is given for the purpose of description, without thereby being limiting, and given in context with the appended drawings where:

DETAILED DESCRIPTION OF THE PREFERRED EMBODIMENTS

Figure 1:
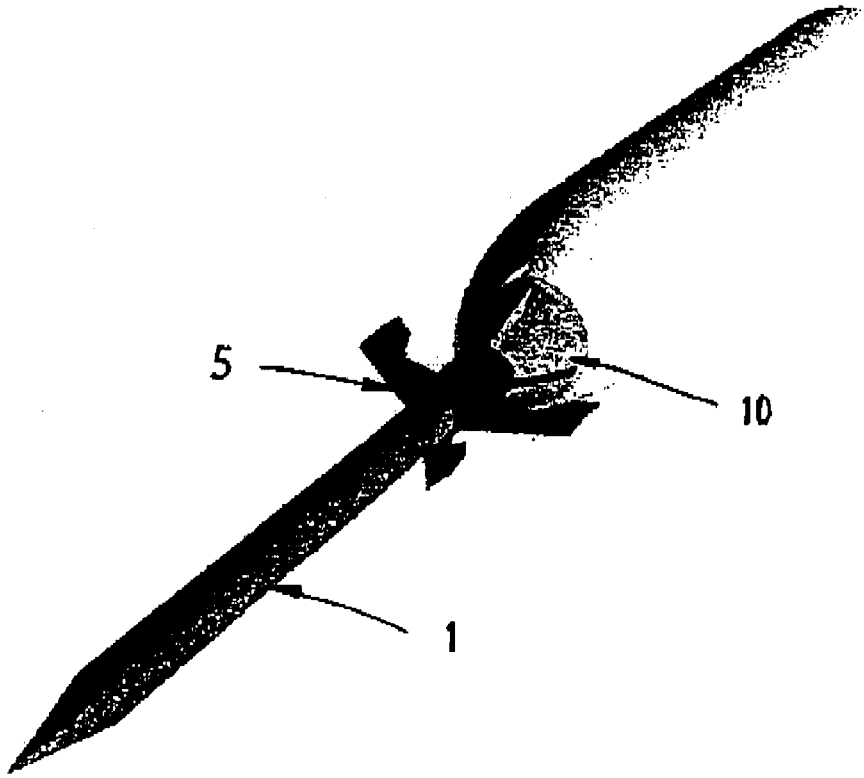
FIG. 1 shows schematically a rocket accelerated penetrator.
Figure 2:
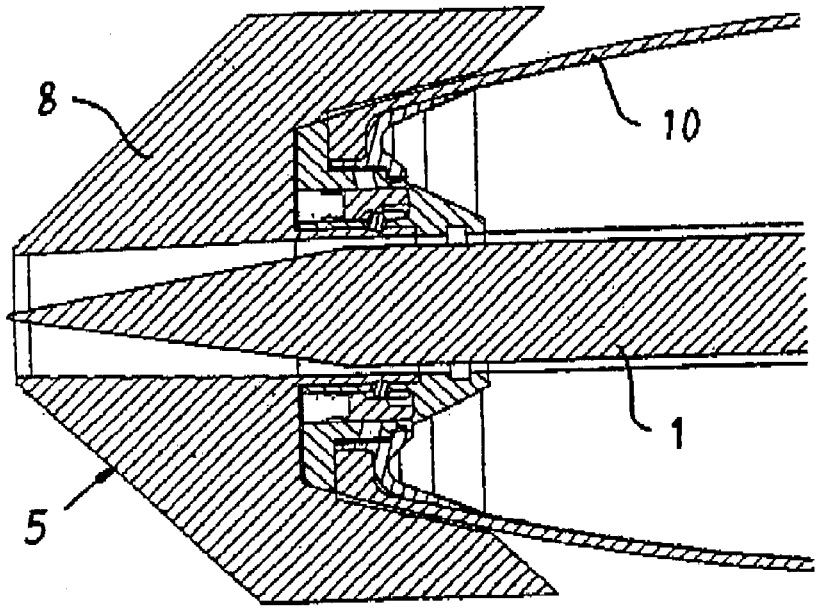
FIG. 2 shows the front end of a penetrator in the storing position thereof inside a control fin part and a rocket motor.

We firstly refer to FIG. 1 that illustrates a missile in flight. The missile comprises a penetrator 1, a control fin part 5 and a rocket motor 10 as main components. The penetrator 1 is an arrow like body having substantial mass, preferably of tungsten. The penetrator is omit warhead and do achieve its destructive effect owing to the kinetic energy thereof FIG. 2 shows the forward pointed end of the penetrator 1 in the way it is lying in standby position in the control fin part 5 and the rocket motor 10 during storage until launching from a launching pipe or launcher (not shown). The reference number 8 refers to one of four control fins that are located circumferentially about a centre and having equal pitch or angular distance from each other. The number of fins 8 can vary according to desire. The rocket motor 10 is releasably fixed to the control fin part 5. The rocket motor 10 is released and does separate from the control fin part 5 during the flight of the missile.

Figure 3:
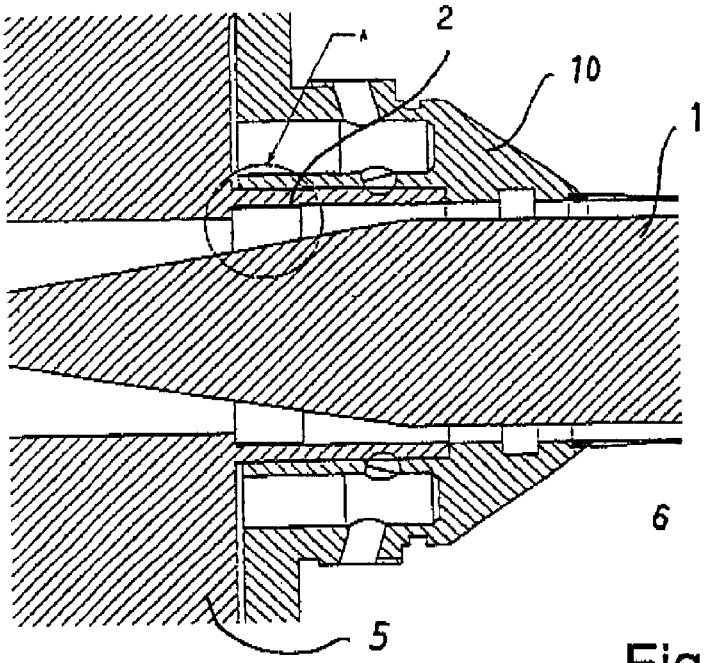
FIG. 3 shows the same as FIG. 2, but in closer detail.
Figure 3A:
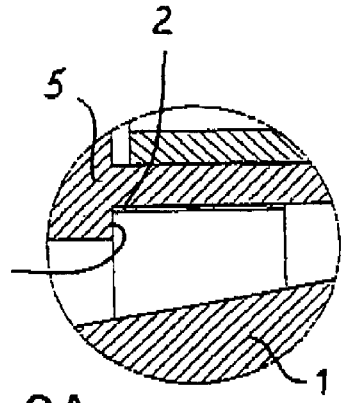
FIG. 3A shows the circumscribed detail of FIG. 3 in enlarged scale.

FIG. 3 shows the front end of the penetrator 1 and the control fin part 5 in closer detail. In the circumscribed area is a sleeve 2 shown that is abutting a shoulder 6 on the internal surface of the control fin part 5. The sleeve 2 is shown further enlarged in FIG. 3A. The sleeve 2 can be manufactured of different materials, be of different geometric configurations and dimensions, all according to those criteria that are determined for retardation and locking. The sleeve is preferably a thin walled tubular element and can be manufactured of materials like steel, aluminium, brass, copper or to the end suitable alloys. The sleeve 2 may as an option have a collar 2*a* in one end or both ends like that indicated in FIGS. 5–11. The sleeve may also, as an alternative, have a slight conical form having the tapering facing towards the shoulder 3 on the body 1 that is moving.

Figure 4:
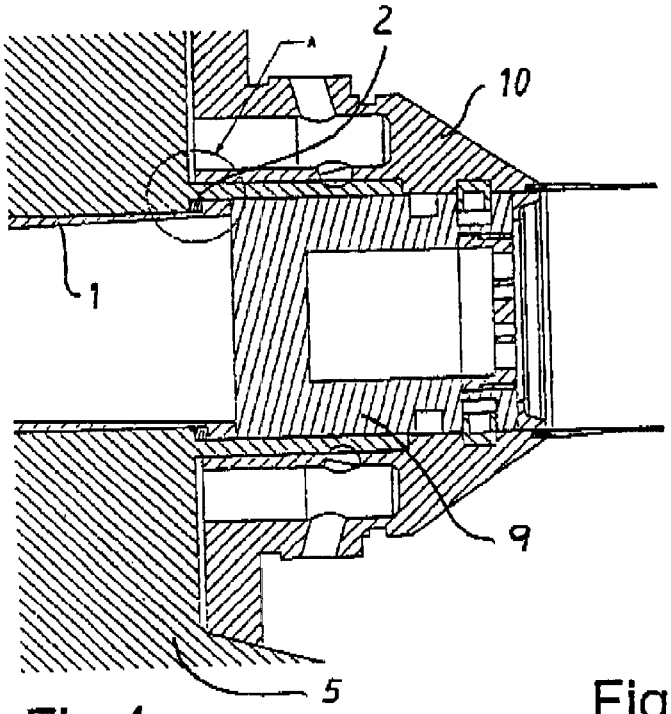
FIG. 4 shows the rear end of a penetrator in launching position and having the control fin part integrated to the penetrator.
Figure 4A:
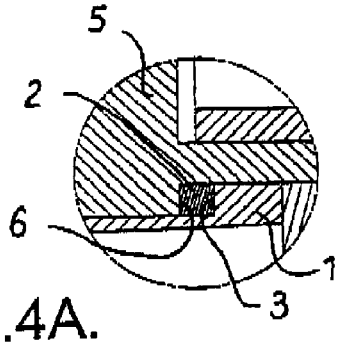
FIG. 4A shows the circumscribed detail of FIG. 4 in enlarged scale.

FIG. 4 shows the rear end of the penetrator 1 when the penetrator 1 is translated through the control fin part 5. The rear end of the penetrator 1 has a shoulder 3 that is directed radially outwards. This shoulder 3 is designed to hit the sleeve 2 in the opposite end to the shoulder 6. A pyrotechnic charge, or igniter charge, propels a piston 9, which again translates the penetrator 1 until the penetrator 1 hits the sleeve 2 by the shoulder 3 thereof. Thus a deformation of the sleeve 2 occurs, which is illustrated in enlarged scale in FIG. 4A when in final position thereof. In FIG. 4A is the compression shown as a number of knife like edges that are folded together in an accordion lice pattern.

As an alternative, the sleeve 2 can initially abut against the shoulder 3 on the penetrator 1 and accompany the penetrator 1 during the translation until the sleeve 2 hits the shoulder 6 on the control fin part 5.

The retardation and interlocking that occurs will now be more explicitly described with reference to FIGS. 5–11. FIGS. 5–11 are highly enlarged sections of those parts that interact during retardation, i.e. the sleeve 2, the rear end of the penetrator 1 including the shoulder 3 and the control fin part 5 including the shoulder 6. The figures are an animation sequence that is to illustrate the progressive deformation that occurs in a conceived longitudinal element of the sleeve 2. Seven phases of the deformation are shown.

Figure 5:
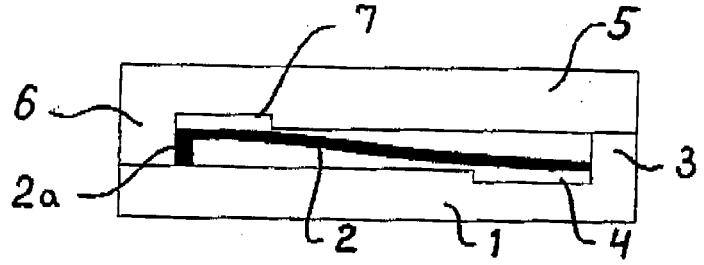
FIGS. 5–11 show in detail and in enlarged scale sequences during the integration process between the penetrator and the control fin pat.

FIG. 5 shows the situation when the shoulder 3 on the penetrator 1 hits the sleeve 2. It is to be noted that the penetrator 1 also may include a groove 4, or recess, adjacent to the shoulder 3 and this groove 4 is facing radially inwards. Correspondingly may the control fin part 5 have a groove 7, or recess, adjacent to the shoulder 6 and this groove 7 is facing radially outwards. The groves 4,7 shall have the function that the respective ends of the sleeve 2 are deformed into the grooves and provide a safer axial and radial locking of the penetrator 1 to the control fin part 5. The grooves 4,7 extend circumferentially in the same way as the shoulders 3,6.

It is further to be understood that in respect of the missile can the sleeve 2, the external surface of the penetrator 1 and the internal surface of the control fin part 5, have cylindrical surfaces (machined), optionally polygonal surfaces (milled) or serrated or rough surfaces. The surfaces may also differ from each other such that the sleeve for instance is cylindrical while the other two surfaces are serrated or polygonal, or one is serrated while the other is polygonal. These optional surfaces may also be confined to only apply for the bottom surface of the grooves 4,7.

Figure 6:
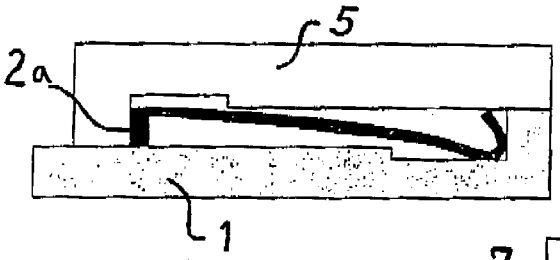
Figure 7:
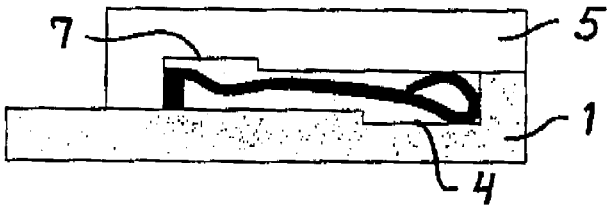

FIG. 6 shows a stage where the deformation of the sleeve 2 is initiated and the retardation of the penetrator 1 occurs. As illustrated in FIGS. 6 and 7 do the ends of the sleeve 2 curl into the respective grooves 4,7 simultaneously with that the sleeve 2 commence buckling in the intermediate part thereof.

Figure 8:
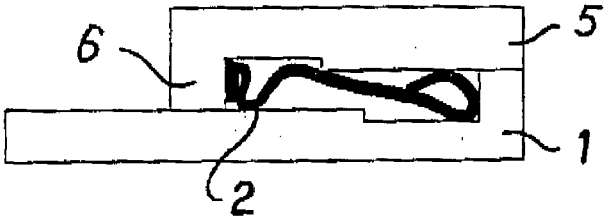

FIG. 8 shows further deformation of the sleeve 2 and further braking and retardation of the penetrator 1 occurs. Further curling up of the sleeve 2 in the grooves 4,7 proceeds while the intermediate part of the sleeve 2 undergoes additional buckling.

Figure 9:
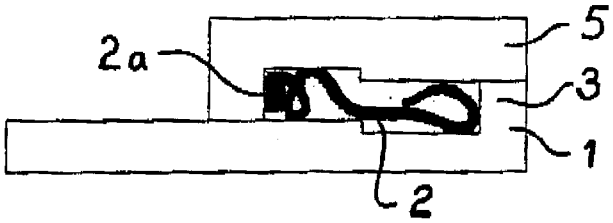
Figure 10:
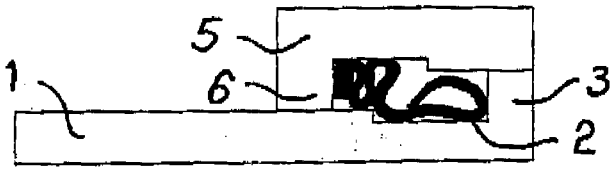

FIG. 9 shows still more buckling of the sleeve 2 and FIG. 10 shows the state of the sleeve 2 just before the penetrator 1 is totally braked. The braking may, as an example, happen over a length of 10–15 mm with a sleeve 2 having a length of 20 mm.

Figure 11:
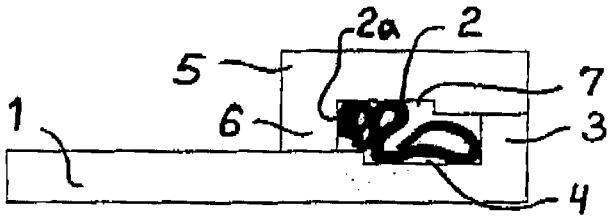

FIG. 11 shows the ultimate deformation of the sleeve 2 when the penetrator 1 is completely braked. The respective bucklings have now hit the external surface of the penetrator 1 and the internal surface of the control fin part 5 and have been forced to fixed engagement with respective surfaces. The crest and valley of the folds form knife like edges that bite into the respective surfaces. By certain configuration and material selection of the sleeve 2, these knife like edges are enabled to orient more randomly than to be lying in a radial plan only. This is material in order to lock the penetrator 1 to the control fin part 5 not only in an axial direction, but also such that locking against mutual rotation between the parts occur.

It is to be noted that the configuration or design of the sleeve 2 together with the selection of materials will be deciding for in which way the sleeve will be deformed. The essential is to achieve a jagged internal and external structure having good interlocking properties against the respective internal and external surfaces on the bodies 1,5. The jagged structure can preferably consist of a large number of short knife like edges having a more or less random orientation such that secure interlocking between the bodies 1,5 is achieved both axially and in respect of mutual rotation between the parts.

What is claimed is:

1. A retarding and locking mechanism for use between a projectile and a control fin part in a missile, wherein the projectile is activatable to motion and guided in the control fin part and, after a predetermined movement of the projectile, the projectile is retarded and interlocks with the control fin part and forms together a unitary, or integrated body, wherein the projectile has a radially outwards directed shoulder and the control fin part has a radially inwards directed shoulder, and wherein an axially compressible substantially inelastic element is provided between the shoulders, wherein the axially compressible element retards the projectile to stop while simultaneously substantially inelastically expanding the element radially and locking the projectile to the control fin part.

2. The retarding and locking mechanism of claim 1, wherein the compressible element is lying in a standby position against the radially outwards directed shoulder.

3. The retarding and locking mechanism of claim 1, wherein the compressible element is lying in a standby position against the radially inwards directed shoulder.

4. The retarding and locking mechanism of claim 1, wherein the compressible element is in the form of an inelastically deformable sleeve.

5. The retarding and locking mechanism of claim 4, wherein the compressible sleeve is conical.

6. The retarding and locking of claim 4, wherein a collar is provided at at least one of the ends of the sleeve.

7. The retarding and locking mechanism of claim 1, wherein the projectile and the control fin part and the compressible element are cylindrical in the contact surfaces thereof.

8. The retarding and locking mechanism of claim 1, wherein the projectile, the control fin part, and the compressible element, independent of each other, on at least areas thereof comprise at least one of a polygonal surface, serrated surface, and rough surface.

9. The retarding and locking mechanism of claim 1, wherein the inwards directed shoulder comprises an outwards directed recess with respect to the internal surface of the control fin part.

10. The retarding and locking mechanism of claim 1, wherein the outwards directed shoulder comprises an inwards directed recess with respect to the external surface of the projectile.

11. The retarding and locking mechanism of claim 9, wherein the recesses, after interlocking, are axially staggered with respect to each other.

12. The retarding and locking mechanism of claim 1, wherein the projectile is a penetrator.

13. The retarding and locking mechanism of claim 10, wherein the recesses, after interlocking, are axially staggered with respect to each other.

* * * * *